US010661143B2

(12) United States Patent
Stahl

(10) Patent No.: US 10,661,143 B2
(45) Date of Patent: May 26, 2020

(54) ASSEMBLY FACILITATING A PROPER SWING MOTION

(71) Applicant: Herbert Darius Stahl, Chestermere (CA)

(72) Inventor: Herbert Darius Stahl, Chestermere (CA)

( * ) Notice: Subject to any disclaimer, the term of this patent is extended or adjusted under 35 U.S.C. 154(b) by 0 days.

(21) Appl. No.: 16/046,922

(22) Filed: Jul. 26, 2018

(65) Prior Publication Data

US 2018/0326280 A1 Nov. 15, 2018

Related U.S. Application Data

(63) Continuation of application No. 14/563,168, filed on Dec. 8, 2014, now abandoned.

(51) Int. Cl.

| | |
|---|---|
| ***A63B 69/36*** | (2006.01) |
| ***A63B 24/00*** | (2006.01) |
| ***A63B 71/06*** | (2006.01) |

(52) U.S. Cl.

CPC ..... *A63B 69/3608* (2013.01); *A63B 24/0003* (2013.01); *A63B 69/3667* (2013.01); *A63B 71/0622* (2013.01); *A63B 2071/0625* (2013.01); *A63B 2071/0655* (2013.01); *A63B 2220/803* (2013.01); *A63B 2225/50* (2013.01); *A63B 2225/54* (2013.01)

(58) Field of Classification Search

CPC ..... A63B 69/3608; A63B 2071/0625; A63B 24/0003; A63B 69/3667; A63B 71/0622; A63B 2071/0655; A63B 2220/503; A63B 2225/50

See application file for complete search history.

(56) References Cited

U.S. PATENT DOCUMENTS

| | | | | |
|---|---|---|---|---|
| 5,511,789 A * | 4/1996 | Nakamura | ..... | A63B 69/3608 473/202 |
| 6,778,866 B1 * | 8/2004 | Bettwy | ..... | A63B 24/0006 434/247 |
| 2011/0183783 A1 * | 7/2011 | Rahim | ..... | A63B 71/0622 473/422 |
| 2014/0366650 A1 * | 12/2014 | Thillainadarajah | .... | A63B 69/36 73/862.625 |

* cited by examiner

*Primary Examiner* — Michael D Dennis
(74) *Attorney, Agent, or Firm* — Orin Del Vecchio

(57) ABSTRACT

A training assembly structured to facilitate a swing motion of a user, during performance of a sports activity, including a receiver and a transmitter both mounted on predetermined portions of the user's body, such as the hip and arm. The arm mounted transmitter is movable relative to the receiver and is structured to communicate and activating signal to the receiver when disposed a predetermined distance there from, representative of a reactive segment of the swing motion. The receiver is structured to generate and deliver and indicating signal to the user for purposes of indicating that the reactive segment of the swing motion has been reached. The reactive segment is thereby determinative of when the user instigates a complementary adjustment of the user's body, during the swing motion, such as rotating the user's hips during a preferred part of the swing motion.

10 Claims, 6 Drawing Sheets

ASSEMBLY FACILITATING A PROPER SWING MOTION

BACKGROUND OF THE INVENTION

Field of the Invention

This invention is directed to an assembly which may be mounted on the user's body or disposed, at least in part, remote from the user and includes a receiver and a transmitter. The receiver and the transmitter are cooperatively structured for wireless communication of an activating signal from the transmitter to the receiver during a "reactive segment", of the swing motion. As a result an indicating signal is delivered to the user, by the receiver, to indicate to the user when a complementary adjustment of the user's body, such as hip rotation, should occur during the swing motion.

Description of the Related Art

Many physical activities including, but not limited to, various sports activities involve what may be generically referred to as a "swing motion". The performance of a correct or preferred swing in any one of a plurality of different sports activities or exercises will typically involve the coordinated movement of various portions of an individual's body including the hands, arms, hips and legs.

With specific but nonexclusive reference to the game of golf, perhaps the hardest portion of the swing motion involves the proper turning of the torso, specifically including a timely turning or rotation of the hips of the player. It is emphasized that while certain examples presented herein will relate to the game of golf, other activities involving the performance of a preferred swing also require proper and timely hip rotation in order to perform the swing in a preferred manner. As such, hip rotation during a predetermined part of the swing will result in maximum power and increased accuracy. In addition to golf, other sports activities typically requiring a proper swing motion include baseball, hockey, lacrosse, rugby, etc. In these activities a user utilizes an appropriate or recognized sports club, such as a baseball bat, hockey stick, lacrosse stick, etc. Accordingly, it is well recognized that the preferred performance of a swing, when utilizing any of the above noted sports clubs, includes the pivoting or moving of the hips of the player during a preferred part of the swing motion. In addition to sports involving the use of a specific club, the activity of throwing a ball, such as during the playing of football, baseball, etc. also involves a proper swing motion and an appropriate hip rotation at a precise or preferred part of the of the swing or throwing motion.

Many training devices and techniques have been proposed for aiding a person in the execution of a preferred or proper swing motion. Such devices or techniques, while assumed to be at least minimally operative for their intended purpose, may suffer from one or more recognized disadvantages. By way of example many conventional procedures involve the teaching or description of one or more incorrect techniques during the performance of a swing motion. Such negative techniques are presented to an individual in an attempt to emphasize the proper or correct technique when performing a given swing motion. Further by way of example, the use of many known devices involve a significant expense and/or require a significant amount of time to accomplish the intended training procedure. Also, many of the known training devices or procedures are significantly complex and/or may require additional participants to facilitate the monitoring and evaluation of the practice swings during the training procedure. In addition, such known approaches may involve the presenting of a model or patterned swing which an individual attempts to duplicate. As a result, individuals attempting to improve or perfect a swing motion become confused and frustrated resulting in a failure to continue utilizing many of the known devices and/or techniques as set forth above.

Therefore, there is a need in this area for a system, method and/or assembly which facilitates the training of an individual in the performance of a proper swing motion. Moreover, such a proposed training assembly, etc. should be specifically, but not necessarily exclusively, directed to the performance of a proper rotation or turning of the hips during a specific part or "reactive segment" of the swing motion. As indicated above, a preferred and proposed training procedure and assembly should be significantly versatile and be capable of modifying modify the training procedure to accommodate a specific swing motion associated with a different sports or other activity. Further, such individual activities may or may not include the use of a sports club as indicated.

Also, a preferred and proposed assembly training an individual in the performance of a preferred or proper swing motion should be capable of being used independently of other individuals. However, the operational versatility of such a proposed training assembly should, in certain preferred circumstances, be capable of use in coordination with at least one individual such as, but not limited to a "swing coach". Finally, a proposed training assembly of the type set forth herein should be relatively inexpensive, long-lasting, easy to "install" or utilize and be capable of accomplishing the intended purpose of facilitating a player's swing motion, regardless of whether the swing motion involving a sports club or merely the act of throwing.

SUMMARY OF THE INVENTION

The present invention comprises a training assembly structured to facilitate the timely performance of a proper swing motion when practicing or playing a sports activity. As indicated herein, many sports activities involve the performance of a "swing motion" including, but not limited to the game of golf, baseball, hockey, lacrosse, etc. In these types of activities a user utilizes an appropriate sports club such as a golf club, baseball bat, hockey stick, lacrosse stick, etc. When involved in such activities, it is well recognized that the preferred performance of a swing utilizing any and/or all of the above noted type of sports clubs also includes the pivoting, rotating or proper moving of the hips, on a timely basis and during a predetermined part of the swing. Moreover, the user must instigate and accomplish such hip movement during a "reactive segment" or preferred part of the swing motion. As used herein, the term "reactive segment" is meant to define and describe a portion of the swing motion during which hip rotation or other preferred hip movement should be initiated by an individual. It is also emphasized that activities which do not involve the use of a sports club, such as throwing a ball, also requires proper hip rotation. Accordingly, the throwing of a ball such as during the playing of football, baseball, etc. also involves a "swing motion" and an appropriate, timely hip movement in order to assure proper power and accuracy.

Therefore, one or more preferred embodiments of the assembly of the present invention facilitate the performance of the preferred swing motion by clearly indicating to the user the "reactive segment" of the swing, during which the hips should be properly rotated. As such, the assembly of the present invention includes a receiver operatively disposed in a first predetermined vicinity on or relative to the user. A transmitter is also operatively disposed in a second predetermined vicinity on or relative to the user and also relative to the receiver. The receiver and the transmitter are cooperatively structured for wireless communication of an activating signal generated by the transmitter and delivered therefrom to the receiver. Upon receipt of the activating signal, the receiver is structured to transmit an indicating signal to the user. The indicating signal is intended to inform or indicate to the user when hip rotation should be instigated. More specifically the user should be informed to instigate hip rotation during the "reactive segment" of the swing motion. Again, referring to the non-exclusive example of golf, rotation of the hip movement may begin at the top of the back swing and when the golfer begins the downswing.

Further, the form or configuration of the indicating signal may vary dependent, at least in part, on the first and second vicinities. Also, as used herein the first vicinity and the second vicinity may be descriptive of the positions of the receiver and transmitter relative to the user and relative to one another and more specifically include, the relative locations and/or distances between the transmitter and the receiver. Moreover, one preferred embodiment of the present invention includes the first predetermined vicinity defined by the receiver being mounted on the user preferably at a predetermined location such as adjacent one the hip of the user. When the receiver is so mounted, the indicating signal delivered by the receiver may be in the form of a generated sound of sufficient loudness to be easily heard during the performance of the swing motion. As indicated, the receiver generates the indicating signal upon receipt of the activating signal from the transmitter, where in the transmitter generates and communicates the activating signal during the aforementioned "reactive segment" of the swing motion. In contrast, the indicating signal may also comprise a mechanical impulse, movement and/or vibration applied directly to the user. Such a mechanical impulse will also serve to inform the user that the "reactive segment" of the swing motion has been reached and that rotation or other intended movement of the hips must be instigated.

The receiver may include a variety of different wireless communication devices specifically including, but not limited to, a wireless mobile communication device such as a cell phone, smart phone, etc. As such the mobile communication device may be preprogrammed to generate the aforementioned indicating signal in the form of a generated sound and/or mechanical vibration. As indicated either the sound heard by the player or the mechanical vibration felt by the player will inform the player that the reactive segment of the swing motion has been reached.

In further contrast, the receiver may include or be operatively associated with an impulse generator disposed in direct confronting and/or engaging relation to the user body. Moreover, the impulse generator may be in the form of an electrical impulse generator, disposed an electrically conductive relation to a predetermined portion of the players body. As such an electric charge or electric shock is delivered to the body of the user. Naturally, the "strength" of such an electric shock will not be such as to injure or cause pain or discomfort, but rather be sufficient to be clearly noticed by the player and be indicative that the reactive segment of the swing motion has been reached. In the alternative the impulse generator may be structured to deliver a mechanical impulse, such as in the form of a mechanical vibration, as indicated above. Also, the mechanical impulse generator may be in the form of a spring-loaded plunger device which, upon receiving the activating signal, generates the indicating signal by triggering the plunger to mechanically impulse the predetermined body portion of the user.

In cooperation with the receiver being mounted in a first predetermined vicinity, such as on the user's body, the second predetermined vicinity may be defined by the transmitter also being mounted on the user's body. In one preferred, but non-exclusive example, when the user is right-handed, the receiver may be mounted adjacent the right hip and the transmitter may be mounted on the right wrist or other portion of the right arm. As such, the transmitter will be disposable at variable distances from the receiver during the performance of the swing motion. In this preferred embodiment one or both of the transmitter and receiver may include a proximity determining assembly such as, but not limited to, one or more proximity oriented RFID tags. Therefore, during the performance of the swing motion, the transmitter will be continuously disposed at greater distances from the receiver, wherein such an increase in the distance between the transmitter and the receiver will be recognized by the proximity determining assembly. When the transmitter reaches the "reactive segment" of the swing motion it will be disposed a predetermined and possibly preprogrammed the distance from the receiver. As a result, the activating signal is generated by and delivered from the transmitter to the receiver resulting in the receiver generating and delivering the aforementioned indicating signal to the user. Upon receiving the indicating signal, in any of the above forms, the user will thereby be informed that the portion of the swing motion, where the rotation of the hips is to be instigated has been reached. As a result, the player will begin and follow through with the proper hip movement which may also be referred to herein as a "complementary adjustment" to the swing motion. This "complementary adjustment" will specifically include, but not necessarily be limited to, a rotation of the user's hips during the reactive segment of the swing motion thereby providing the swing with the appropriate power of the user's body.

As indicated above the term "swing motion" as used herein may involve the use of a sports club dependent on the sports or other activity being performed. The same "complementary adjustment" of the swing motion may be preferred and/or desired when the user is merely throwing a ball, as also indicated above. Regardless, when using sport clubs or just involved in a throwing motion, the user's wrist, arm, etc. on which the transmitter is mounted will move substantially continuously away from the hip area on which the receiver is mounted. As a result, the transmitter, or more specifically the proximity determining assembly will be preprogrammed. The transmitter will be cooperatively structured and operative to generate and wirelessly deliver the activating signal when it has been determined that the "reactive segment" of the swing motion has been reached.

In yet another preferred embodiment of the present invention the second predetermined vicinity or location of the transmitter relative to the user and the receiver, mounted on the user, comprises the transmitter being located remotely from the user. Therefore, in this embodiment the user may be associated with a "swing coach" or other individual who has operative control of the transmitter. This other individual will be "remotely" viewing the swing motion. As a result, when the swing coach or other individual observes that the "reactive segment" of the swing motion has been reached, the swing coach will manually activate the transmitter in turn causing the generation and wireless delivery of the activating signal to the receiver. Similar to the one or more previously described embodiments, upon receipt of the activating signal the receiver will generate the indicating signal. The indicating signal will be delivered directly to the user and preferably, but not necessarily, be defined by a generated sound, mechanical vibration, mechanical impulse, electric shock, etc.

These and other objects, features and advantages of the present invention will become clearer when the drawings as well as the detailed description are taken into consideration.

BRIEF DESCRIPTION OF THE DRAWINGS

For a fuller understanding of the nature of the present invention, reference should be had to the following detailed description taken in connection with the accompanying drawings in which.

Like reference numerals refer to like parts throughout the several views of the drawings.

DETAILED DESCRIPTION OF THE PREFERRED EMBODIMENT

The various preferred embodiments of the present invention are represented in FIGS. 1 through 6. More specifically the training assembly is generally indicated as 100 and is further represented as being used with an individual, user or player generally indicated as 102. The training assembly 100 is structured to facilitate the performance of a proper swing motion, perhaps best represented in FIG. 5, such as used in the practicing or performance of a sports activity. As also indicated herein, many sports activities involve the performance of a proper "swing motion" including but not limited to the game of golf. For purposes of clarity the training assembly 100 of the present invention will be primarily demonstrated and described with reference to a "swing motion" used in the game of golf. However the versatility and operative features of the training assembly 100 is capable of being used in the performance and training of swing motions associated with other sports including baseball, hockey, lacrosse, and/or other activities which incorporates the use of a sports club. However, the training assembly 100 is not limited to the training or facilitation of a swing motion of an individual utilizing an appropriate sports club. Accordingly, the term "swing motion" is also used to describe an individual involved in a throwing motion, such as when throwing a ball or like object.

Accordingly, one or more preferred embodiments of the training assembly 100 facilitate the performance of a preferred swing motion by indicating to the user or player 102 when a "reactive segment" of the swing motion has been reached. The indication of the reactive segment to the player 102 is for the purpose of informing the player 102 when the hips, generally indicated as 104 should be rotated, moved or properly positioned to accommodate and facilitate a proper or preferred swing motion, dependent upon the specific sports or other activity being performed by the player 102.

Figure 2:
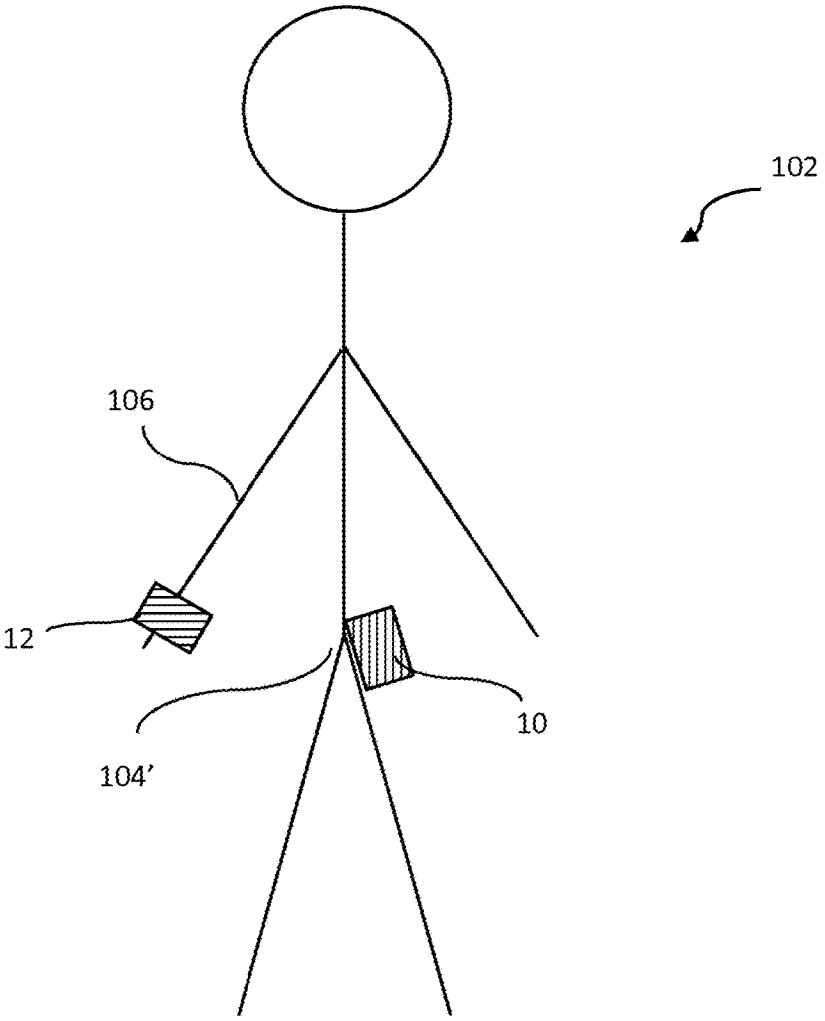
FIG. 2 is a schematic representation of a user performing a "swing motion" and having the embodiment of the training assembly of FIG. 1 mounted thereon.
Figure 3:
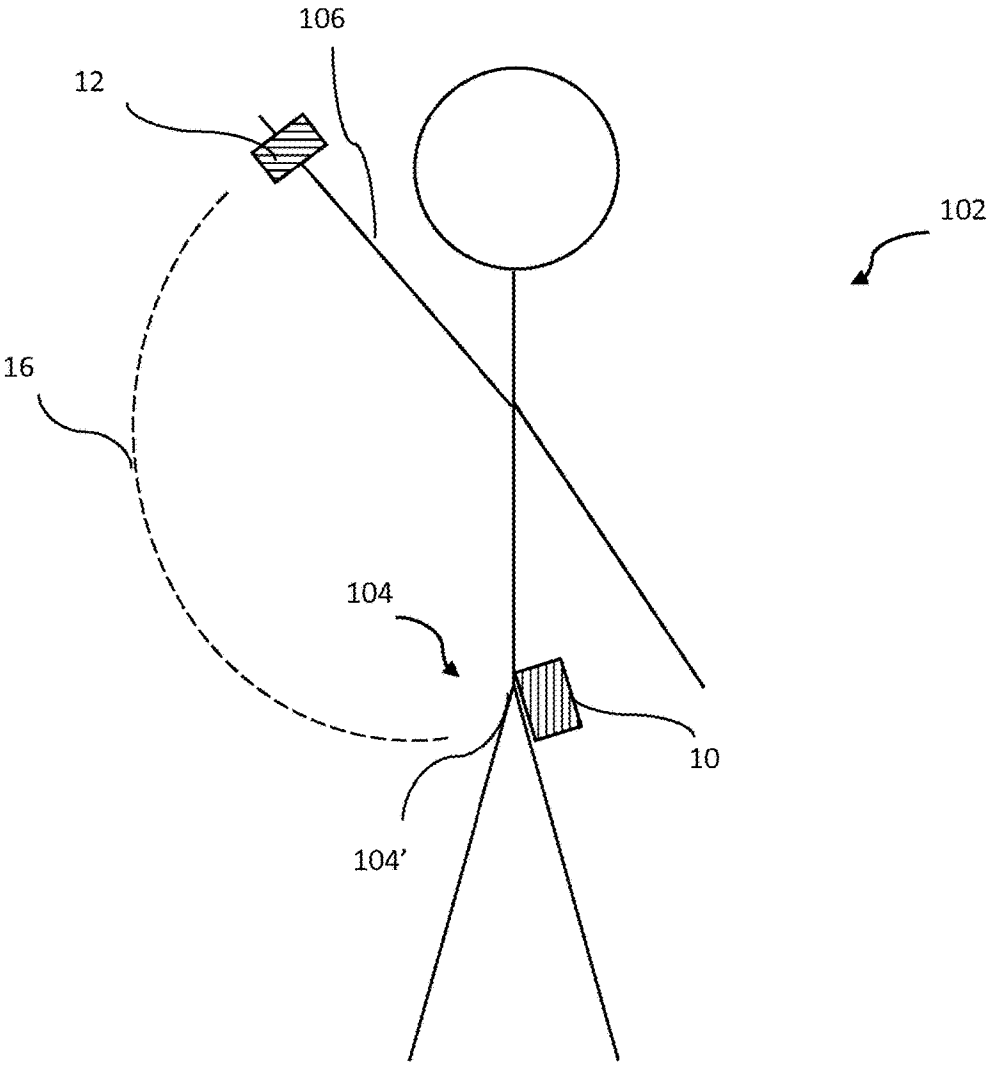
FIG. 3 is a schematic representation of the embodiment of FIG. 2 wherein the transmitter and the receiver are disposed at a predetermined distance from one another being representative of a "reactive segment" of a swing motion being performed by the user.
Figure 4:
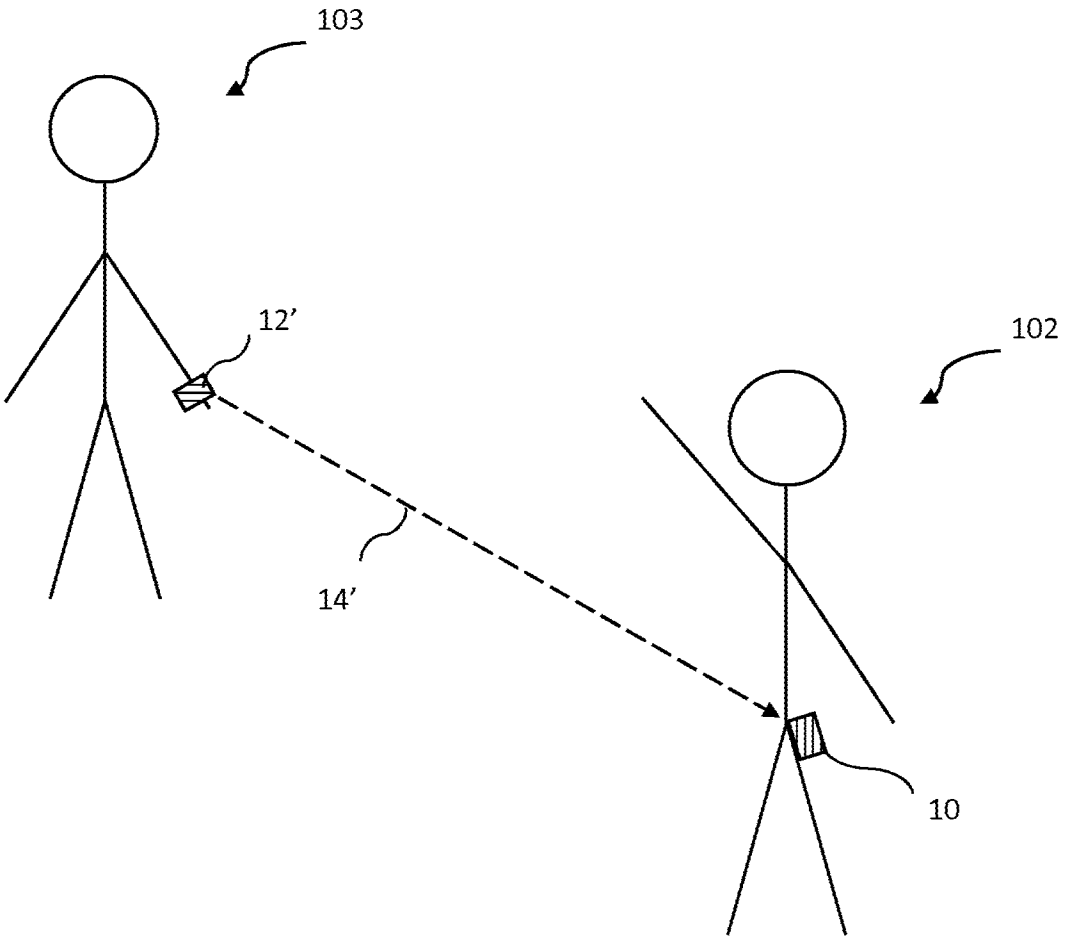
FIG. 4 is a schematic representation of the embodiment of FIGS. 1 and 2 wherein portions of the training assembly of the present invention are located remotely from one another.

As schematically represented in the FIGS. 1-5, the training assembly 100 includes a receiver 10 and a transmitter 12. As also shown throughout the Figures, the receiver 10 is located within a first predetermined vicinity relative to the user or player 102 such as, but not limited to being mounted directly on the player 102. In addition, the transmitter 12 is operatively located within a second predetermined vicinity relative to the player 102 and receiver 10. The second predetermined vicinity may be defined by the transmitter being mounted on the player 102 or being located remotely therefrom as schematically represented in FIG. 4, to be described in greater detail hereinafter.

Figure 1:
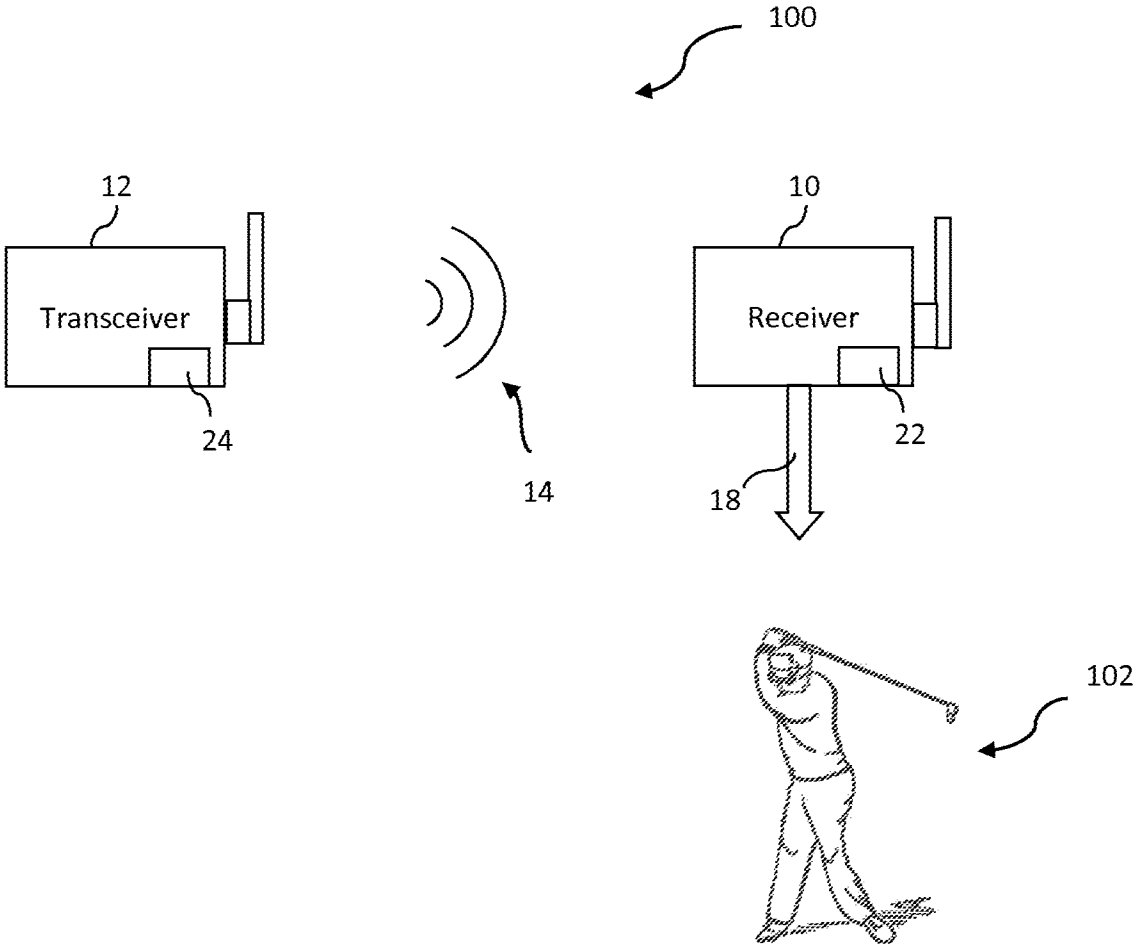
FIG. 1 is a schematic representation of the training assembly of the present invention mounted on and being operative with a user.

The receiver 10 in the transmitter 12 are cooperatively structured for wireless communication with one another. As represented in FIG. 1, the transmitter 12 is structured to generate and wirelessly transmit an activating signal 14 to the receiver 10 upon a predetermined distance 16 (see FIG. 3) existing between the receiver 10 and transmitter 12. Upon receipt of the activating signal 14, the receiver 10 is structured to transmit and communicate an indicating signal 18 to the user 102. The indicating signal 18 is operative to inform the user 102 when the hip rotation or hip movement should be instigated, based on the fact that the "reactive segment" of the swing has been reached by the transmitter 12. The indicating signal 18 being transmitted to the user 102 during a "reactive segment" of the swing motion will be explained in greater detail with reference to FIG. 5. Also, the form or configuration of the indicating signal 14 may vary dependent, at least in part, first and second predetermined vicinities or relative positions or locations of the receiver 10 and transmitter 12. In more specific terms the relative location between the receiver 10 and transmitter 12 may be determinative of the form or configuration of the indicating signal, generated by the receiver 10.

Accordingly, one preferred embodiment of the present invention, is represented in FIGS. 1-3 and 5 and includes a first predetermined vicinity defined by the receiver 10 being mounted on the user. Preferably the receiver 10 is disposed at a predetermined location such as adjacent a selected hip 104'. When the receiver 10 is so mounted, the indicating signal 18 may be in the form of a generated sound of sufficient loudness to be easily heard during the performance of the swing motion by the user 102. As indicated herein, the indicating signal 18, being in the form of a generated sound, is generated and delivered during the "reactive segment" of the swing motion. In contrast, the indicating signal 18 may also comprise a mechanical impulse such as, but not limited to, a vibration applied directly to the user 102, such as about the hip 104'. Such a mechanical impulse will serve to inform the user that the "reactive segment" of the swing motion has been reached and that rotation or other intended movement of the hips 104 should be instigated by the user 102.

The receiver 10 may include a variety of different wireless communication devices specifically including, but not limited to, a wireless mobile communication device such as a cell phone, smart phone, etc. As such, the mobile communication device may be preprogrammed to generate the aforementioned indicating signal 18 in the form of the generated sound and or mechanical vibration. As further indicated, either the sound heard by the player 102 or the mechanical vibration felt by the player 102 informs the player 102 that the reactive segment of the swing motion has been reached. As explained in greater detail hereinafter, determination of the "reactive segment" of the swing will be based on the transmitter 12 being located a predetermined, preprogrammed distance from the receiver 10, as it travels with the arm or wrist of the user 102 during the swing motion.

Figure 6:
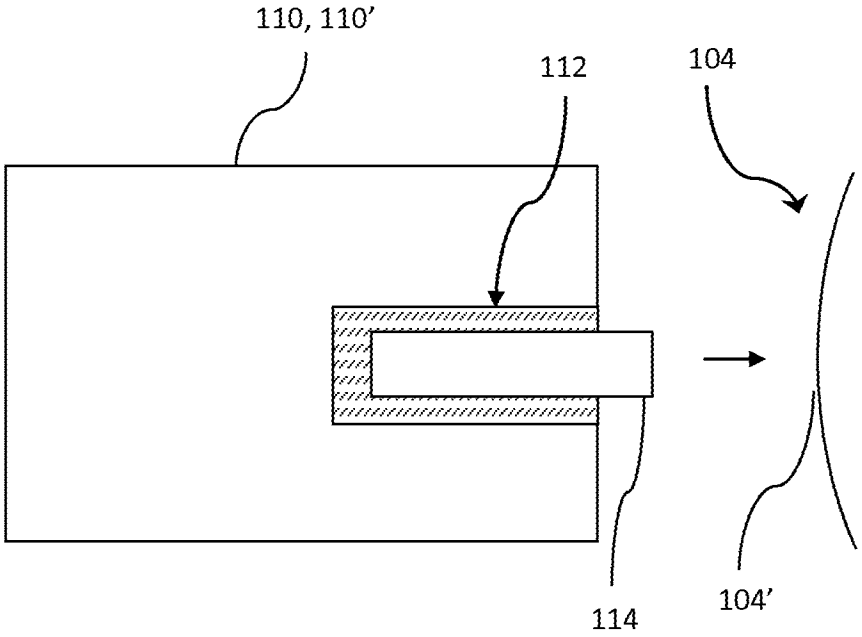
FIG. 6 is a schematic representation of a mechanical impulse generator associated with the receiver of the embodiment of FIGS. 1-4.

As another representative embodiment of the training assembly 100, the receiver 10 may include or be operatively associated with an impulse generator 110 disposed in direct confronting and or engaging relation to a portion of the body of the user 102, such as adjacent either of the hips 104', as schematically represented in FIG. 6. Moreover, the impulse generator 110 may be in the form of an electrical impulse generator, disposed in electrically conductive relation to a predetermined portion or hip 104' of the player 102. As such, an electric charge or electric shock is delivered to the body or hip portion 104'. Alternatively, the impulse generator 110' may be structured to deliver a mechanical impulse and be in the form of a mechanical impulse generator. The mechanical impulse generator 110' may be in the form of a spring-loaded device 112 having a plunger 114 which is "triggered" when the receiver 10 receives the activating signal 14 from the transmitter 12. The plunger 114 will be forced outwardly into mechanical engaging relation with a corresponding body portion 104' of the hips 104 or other portion of the player's body.

Figure 5:
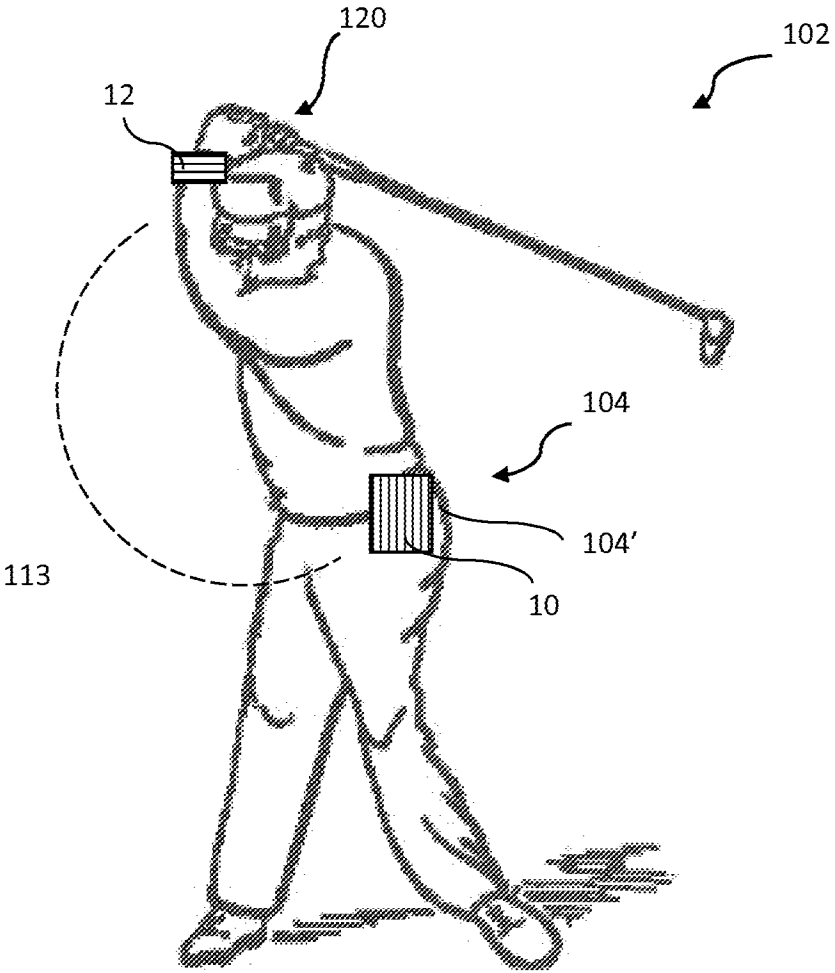
FIG. 5 is a perspective view in partially schematic form representative of a user and the training assembly of the embodiment of FIGS. 1 through 3 mounted thereon, where in the user has reached the "reactive segment" of the swing motion.

In the schematically represented embodiments of FIGS. 1-3 and 5 both the receiver 10 and the transmitter 12 are mounted on the player 102 such as adjacent the hip 104 and arm or wrist 106 respectively. Accordingly, both the first predetermined vicinity and the second predetermined vicinity may be defined by the receiver 10 in the transmitter 12 both being mounted on predetermined body portions of the player 102. Therefore, during the performance of the swing motion, as best represented in FIG. 5, the transmitter 12 will be continuously moved a greater distance from the receiver 10 as it moves with the arm 106 as the player 102 goes through the swing motion. It is again emphasized that the swing as represented in FIG. 5 represents a golf swing. As such, the player 102 is represented during the swing motion and at the top of the backswing. The increase in distance and or the specific distance between the receiver 10 and the transmitter 12 is generally indicated as 113. The distance 113 will be preprogrammed or preset and as a result will be recognized by a "proximity determining assembly" 22, 24. In the embodiment of FIG. 1, the proximity determining assembly may comprise proximity sensitive RFID tags 22 and 24 located respectively on the receiver 10 and the transmitter 12. The RFID tags 22 and 24 or other distance determining components defining the proximity determining assembly may be preprogrammed and/or adjusted to recognize a predetermined separation distance 113 between the receiver 10 and the transmitter 12 which coincides with the "reactive segment" 120 of the swing motion, as generally represented in FIG. 5. Upon reaching the reactive segment 120, the transmitter 12 will be triggered to generate and wirelessly deliver the activating signal 14 to the receiver 10. Upon receipt of the activating signal 14, the receiver 10 will be activated to generate and deliver the indicating signal 18 directly to the player 102. The player 102 will then know to activate a "complementary adjustment" in his or her swing motion. The "complementary adjustment" as used herein is defined as the proper and timely movement or rotation of the hips 104, during the performance of the swing motion.

As schematically represented in FIGS. 2, 3 and 5, the receiver is indicated as being located on the left hip 104' of the user 102, while the transmitter 10 is represented as being located on the right hand of the user 102. However, it is emphasized that the transmitter 10 and the receiver 12 can be located on the same side of the user, or different sides of the user 102. For example and in addition to the representations of FIGS. 2, 3 and 5, when a right-handed user 102 has the transmitter 12 mounted on or connected to the right-hand or other portion on the right side of his/her body, it may be more comfortable or functionally expedient to place the receiver 10 on the corresponding, right hip 104'. Similarly, when the transmitter 12 is mounted on a left-hand or other left side portion of a left-handed user 102, placement of the receiver 10 on the left hip 104' may be more comfortable or functionally expedient.

The versatility of the training assembly 100 is further demonstrated in the additional preferred embodiment of FIG. 4. More specifically, the first predetermined vicinity of the receiver 10 may be defined by it being mounted on an appropriate portion of the player 102 as represented. However, in contrast, the transmitter 12' will be located remote from the player 102 in operative relation by a second individual 103 which may be representative of a "swing coach". As such, the individual 103 observes the swing motion of the player 102. When the swing motion enters or reaches the reactive segment 120, (FIG. 5) the swing coach or other individual 103 will manually activate the transmitter 12' causing the activating signal 14' to be delivered to the receiver 10 from the transmitter 10' from the remote location. As with the above noted embodiments, the form or configuration of the indicating signal 14' may be in the form of a generated sound, a mechanical vibration, a mechanical impulse, etc. While not specifically represented in the Figures both the receiver 10 and the transmitter 12 may include appropriate attachment or connecting structures such as belts, straps, harnesses, etc. dimensioned and configured to position the receiver 10 and the transmitter 12 in appropriate locations on the player's body 102 as set forth in detail above.

Since many modifications, variations and changes in detail can be made to the described preferred embodiment of the invention, it is intended that all matters in the foregoing description and shown in the accompanying drawings be interpreted as illustrative and not in a limiting sense. Thus, the scope of the invention should be determined by the appended claims and their legal equivalents.

Now that the invention has been described,

What is claimed is:

1. A training assembly structured to facilitate a swing motion of a user, said assembly comprising:

a receiver operatively disposed in a first predetermined the vicinity relative to the user, a transmitter operatively disposed in a second predetermined vicinity relative to the user, said receiver and said transmitter cooperatively structured for wireless communication of an activating signal from said transmitter to said receiver, said receiver structured to transmit an indicating signal to the user, upon receipt of said activating signal, said indicating signal dependent on said first predetermined vicinity, said activating signal and said indicating signal collectively operative to determine and indicate a predetermined reactive segment of the swing motion to the user, and said reactive segment determinative of instigation of a complementary adjustment of the user's body during the swing motion, wherein said first predetermined vicinity comprises said receiver being mounted on the user and said second predetermined vicinity comprises said transmitter mounted on the user such that said transmitter is at a variable distance from said receiver during the swing motion, and wherein said transmitter is structured to generate and transmit said activating signal to said receiver upon a predetermined distance existing between said transmitter and said receiver, and wherein said first and said second vicinities comprise said receiver respectively disposed adjacent one hip of the user and said transmitter on a corresponding arm of the user and said predetermined distance is determined by movement of the arm relative to the corresponding hip of the user.

2. The training assembly as recited in claim 1 wherein said indicating signal comprises a generated sound.

3. The training assembly as recited in claim 1 wherein said indicating signal further comprises a mechanical vibration applied to the user.

4. The training assembly as recited in claim 3 wherein said receiver comprises a mobile communication device programmed to receive said activating signal and generate said indicating signal.

5. The training assembly as recited in claim 4 wherein said indicating signal comprises a generated sound.

6. The training assembly as recited in claim 1 wherein said receiver comprises an impulse generator disposed in confronting relation to the user's body; said impulse generator structured to generate and deliver said indicating signal in the form of an impulse to the user.

7. The training assembly as recited in claim 6 wherein said impulse generator comprises an electrical impulse generator disposed in electrically conductive relation to the user's body, said indicating signal comprising an electric charge.

8. The training assembly as recited in claim 6 wherein said impulse generator comprises a mechanical impulse generator structured to generate and deliver said indicating signal in the form of a mechanical impulse to the user.

9. The training assembly as recited in claim 1 wherein said predetermined reactive segment is at least partially defined by said predetermined distance between said transmitter and said receiver during performance of the swing motion.

10. The training assembly as recited in claim 9 wherein said complementary adjustment of the swing motion comprises a complementary movement of the user's hip during the swing motion.

* * * * *